United States Patent [19]

Crow

[11] 4,332,388

[45] Jun. 1, 1982

[54] GOLF CLUB HEAD

[75] Inventor: Thomas L. Crow, La Jolla, Calif.

[73] Assignee: Cobra Golf, Inc. II, San Diego, Calif.

[21] Appl. No.: 123,493

[22] Filed: Feb. 21, 1980

Related U.S. Application Data

[63] Continuation of Ser. No. 919,424, Jun. 26, 1978, abandoned.

[51] Int. Cl.[3] ..... A63B 53/04

[52] U.S. Cl. ..... 273/172; 273/167 A; 273/174

[58] Field of Search ..... 273/77 R, 164, 167 R, 273/167 A, 167 F, 167 J, 169, 171, 172, 173, 174; D21/214

[56] References Cited

U.S. PATENT DOCUMENTS

| | | | |
|---|---|---|---|
| 645,944 | 3/1900 | Dalgleish | 273/174 X |
| 1,089,881 | 3/1914 | Taylor | 273/167 A |
| 1,269,745 | 6/1918 | Robertson | 273/172 |
| 1,433,744 | 10/1922 | Rhind | 273/172 |
| 1,531,821 | 3/1925 | Scott | 273/167 A |
| 1,617,090 | 2/1927 | Worthington | 273/167 A |
| 1,619,566 | 3/1927 | Crankshaw | 273/174 X |
| 1,669,482 | 5/1928 | Miller | 273/174 |
| 1,913,821 | 6/1933 | Stumpf | 273/174 X |
| 2,004,968 | 6/1935 | Young | 273/174 |
| 2,014,829 | 9/1935 | Young | 273/174 |
| 2,447,967 | 8/1948 | Stone | 273/167 F X |
| 2,550,846 | 5/1951 | Milligan | 273/174 X |
| 3,240,497 | 3/1966 | Taylor | 273/174 X |
| 3,761,095 | 9/1973 | Thompson | 273/174 |
| 3,815,921 | 6/1974 | Turner | 273/174 |
| 3,830,503 | 8/1974 | Consoli | 273/167 A |
| 4,063,737 | 12/1977 | Tom et al. | 273/174 |

FOREIGN PATENT DOCUMENTS

| | | | |
|---|---|---|---|
| 27874 | of 1910 | United Kingdom | 273/172 |
| 9136 | of 1911 | United Kingdom | 273/167 A |
| 340579 | 1/1931 | United Kingdom | 273/174 |
| 364845 | 1/1932 | United Kingdom | 273/174 |
| 377463 | 7/1932 | United Kingdom | 273/167 A |
| 452389 | 8/1936 | United Kingdom | 273/172 |

OTHER PUBLICATIONS

"Golf Digest: Baffler (TM.)"; Aug. 1977; p. 30.

*Primary Examiner*—Richard J. Apley
*Attorney, Agent, or Firm*—Brown & Martin

[57] ABSTRACT

A golf club head, specifically a wood for use on the fairway or in trouble spots, such as sand traps, hard pan, or in the rough. The wood incorporates a metal sole plate which comprises a major portion of the lower face of the head and at least half of the total weight of the head. The sole plate has a pair of spaced parallel runners extending well below the plate and being of substantial cross section, the runners having inclined leading faces to ride or skid on the ground surface with minimum penetration. The weight and shape of the sole plate provides a low center of mass in the head, with the weight distributed over the lower face.

3 Claims, 5 Drawing Figures

GOLF CLUB HEAD

This is a continuation of application Ser. No. 919,424, filed June 26, 1978, now abandoned.

BACKGROUND OF THE INVENTION

In lofting a golf ball out of a trouble spot, such as rough or a sand trap, it is customary to use an iron, sand wedge, or the like, with considerable mass in the head to provide the necessary inertia and overcome resistance. The ball is usually struck in a downward direction to impart a back spin to retard rolling on the green and is lofted out by continued motion of the club, the head usually striking the ground immediately after contacting the ball. When the leading edge of the head strikes the ground surface or cuts through grass, the sharp leading edge has a tendency to dig into the turf, greatly reducing the power of the blow and including the possibility of deflecting the club from the desired path.

Ribbing or corrugation of the lower surface of the head has been used to reduce contact area, but there is still a large surface which must be forced through obstacles and the results have not been very satisfactory.

A wood with a pronounced curvature in the sole has been developed for use in the rough or on the fairway, but does not have sufficient mass for good penetration. In weighting a wood the weight is usually centrally located behind the striking point and the weight distribution in the head is not particularly good. Additionally a wood with a sole shaped like a single keel of a boat has been produced. However, this has a sharp leading edge which encourages penetration and greatly reduces the continued power of the swing.

SUMMARY OF THE INVENTION

The golf club head described herein is a wood with the cutting advantages of an iron or fairway wood, combined with the skidding advantage of a sand iron. A wood type head is provided with a metal sole plate extending over the lower surface of the head and constituting about 55% of the total weight of the head. The mass is concentrated in the lower portion of the head, which lowers the center of mass and increases inertia and driving power. The weight is also spread to the edges of the wood for improved weight distribution and balance.

To improve stability the sole plate has a pair of spaced parallel runners of large cross section extending from front to rear, one rib being near the toe and the other adjacent the heel of the sole. The runners are generally semicircular in cross section and extend well below the lower face of the sole plate. The leading faces of the runners are inclined downwardly and rearwardly to act as skids and slide through and over the ground surface with minimum penetration. In grass the resistance is also reduced since the runners keep the body of the head above the surface and the full width of the leading edge does not penetrate so deeply into the grass. On the fairway the head has the characteristics of a wood, but the added weight of the sole plate, with the low center of mass and good weight distribution, improves the driving power and control of the club.

The primary object of this invention, therefore, is to provide a new and improved golf club head.

Another object of this invention is to provide a wood having a metal sole plate with a pair of large runners projecting below the plate to act as skids when the head strikes the ground.

Another object of this invention is to provide a wood with a metal sole plate which extends over the lower surface of the head and constitutes at least half the weight of the head.

A further object of this invention is to provide a wood having a low center of mass with the weight distributed over the sole.

Other objects and advantages will be apparent in the following detailed description, taken in conjunction with the accompanying drawing, in which.

DESCRIPTION OF THE PREFERRED EMBODIMENT

Figure 1:
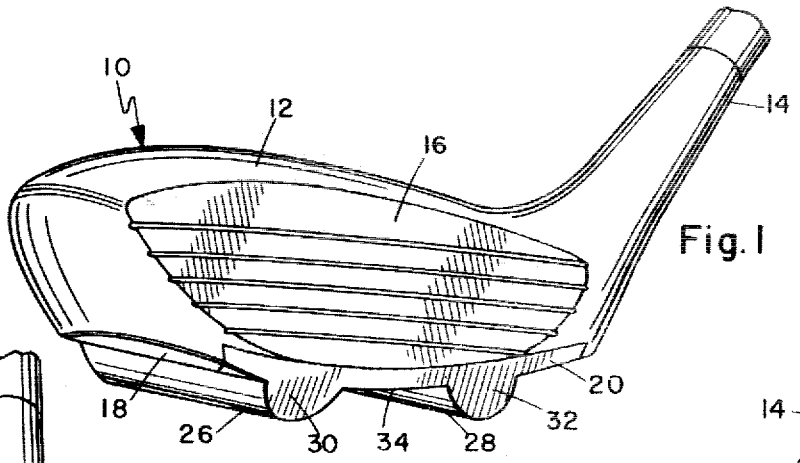
FIG. 1 is a perspective view of the golf club head.

The golf club head 10 has a wood body 12, with a shaft 14, striking face 16 and a sole 18. The configuration can vary considerably, that shown being typical.

Sole 18 is slightly convex and inset into the sole is a metal sole plate 20, which gives the club its unique characteristics. The sole plate 20 can be manufactured in several ways but is preferably made by investment casting for precision and smooth finish, and has sufficient mass to constitute about 55% of the total weight of the head. As illustrated, the sole plate has cut out portions 22 and 24 at the toe and heel, respectively, to key into comparably shaped socket portions cut in body 12 for precise alignment. Except for the cut out portions the sole plate extends over substantially the entire lower surface or sole of the body and follows the convex contour of the sole. The weight is thus well distributed across the head but is concentrated in the lower portion, resulting in a low center of mass for the head.

The sole plate 20 has a pair of spaced parallel runners 26 and 28 projecting downwardly and extending from front to rear across the full width of the plate. Runner 26 is positioned adjacent the toe portion of the head and runner 28 adjacent the heel portion. The runners are substantially semicircular in cross section and are quite large compared to ribbed or grooved structures which have been used.

Figure 2:
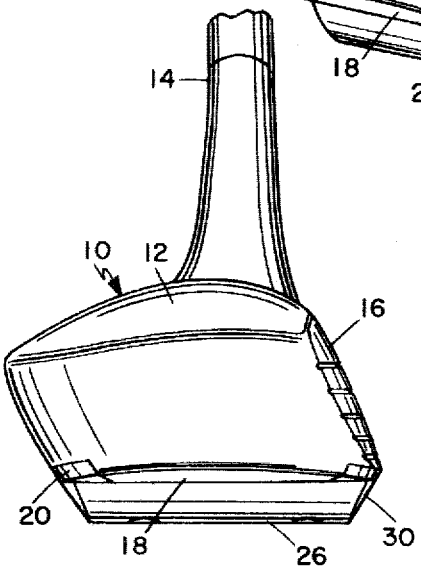
FIG. 2 is an end view taken from the toe end of the head.
Figure 3:
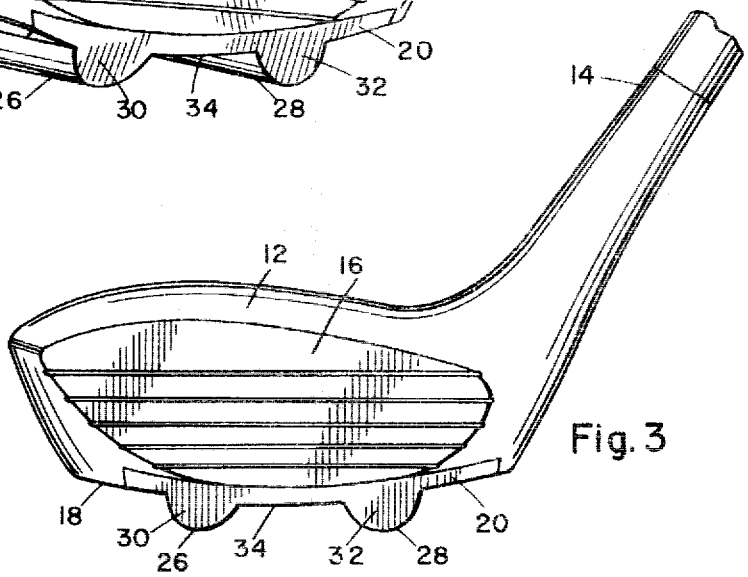
FIG. 3 is a side elevation view of the striking face of the head.
Figure 4:
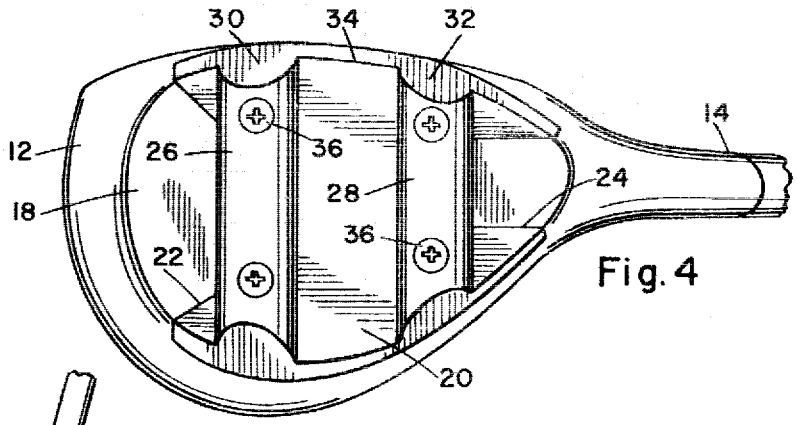
FIG. 4 is an underside view of the head.

While dimensions of the runners may vary, the large size relative to the size of the head is important. In the example illustrated, the runners are about 0.30 inch deep and 0.55 inch wide, with a spacing between centers of about 1.25 inches. The leading faces 30 and 32 of runners 26 and 28, immediately below the leading edge 34 of the sole plate, are inclined downwardly and rearwardly at about 35 degrees from the vertical, or 55 degrees to the horizontal lower surfaces of the runners. The leading edge surface of the sole plate is parallel with and mates with the leading faces of the runners to form a continuous, substantially flat surface as shown in FIG. 2 of the drawing. The rear portion of the sole plate and runners can be contoured to fit the configuration of the body 12, and the rear edge surface of the sole plate is parallel with and mates with the rear faces of the runners to form a continuous, substantially flat surface as shown in FIG. 2 of the drawings. Sole plate 20 is secured to the body 12 by suitable means such as screws 36, which are inserted through the runners 26 and 28.

The heads of the seated screws are finished to blend smoothly into the contours of the runners.

Figure 5:
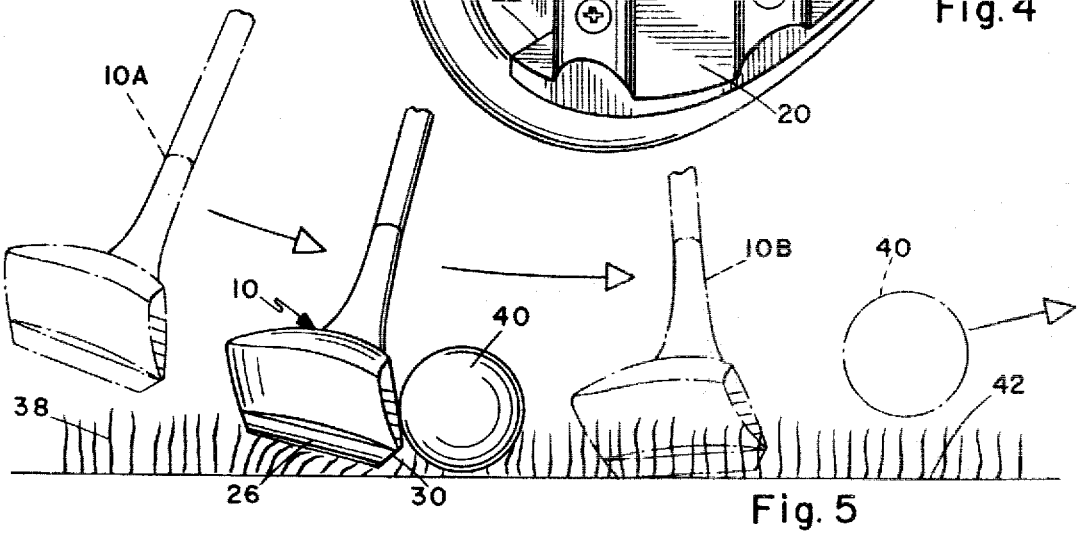
FIG. 5 illustrates the striking action of the head.

A portion of a typical stroke is illustrated in FIG. 5. The approaching head 10A is on a downward swing about to enter the grass 38. The head strikes the ball 40 in a slightly downward direction to apply a back spin, which retards rolling of the ball of the green. As shown, the head is slightly above the ground surface 42 at the point of impact, but could actually contact the ground. When ground contact is made the inclined leading face 30 of runner 26, and face 32 of runner 28, act as skids and cause the head to be deflected along the surface with minimum penetration. Even if the runners do penetrate the ground to any extent, their cross sectional area is much less than the entire leading edge area of the head and resistance is minimized. In the follow through portion of the stroke, indicated at 10B, the head slides along the ground on the runners and then lifts away, as the ball is lofted from the ground.

In grass the leading edge of the head is kept above the ground surface by the runners, so that the full width of the leading edge does not penetrate deeply to the base of the grass. This also minimizes friction or drag of the head.

In stroking out of a sand trap the sand tends to pack ahead of the runners and the inclined leading faces of the runners ride up and out of the sand.

On the fairway the head is used as a wood, but has the advantage of greater weight and good balance for driving power and improved trajectory of the ball. The runners minimize penetration of the turf and tend to stabilize and track the head when it contacts the ground.

The head is thus a multi-purpose wood which can be used on the fairway or in trouble spots, with advantages and desirable characteristics of both a wood and an iron. Due to the deflecting skid action of the large runners the head causes a minimum divot and stresses on the club are reduced.

Having described my invention, I now claim:

1. A golf club head comprising:

a wood body having a front striking face; a lower sole with a toe portion and a heel portion, and means for attachment to a shaft;

a metal sole plate fixed to said sole and having a pair of substantially semi-circular in cross section spaced parallel runners projecting downwardly therefrom and extending from front to rear across the entire sole plate;

said sole plate having a leading edge surface below said striking face;

said runners having flat end surfaces comprising leading faces, which flat end surfaces incline downwardly and rearwardly from said leading edge at an angle of approximately 55 degrees to the longitudinal front to rear lower surface of the respective runners;

said sole plate leading edge surface is parallel with and mates with said leading faces of said runners forming a continuous substantially flat surface;

each of said runners having the same cross-sectional area and the same longitudinal semi-circular configuration, which cross-sectional area and semi-circular configuration are the same throughout the length of each of the runners from the front edge of the sole plate to the rear edge of the sole plate;

said sole plate extends over a major portion of said sole and constitutes approximately 55 percent of the total weight of the head;

said sole plate having slotted openings on each side thereof that extend to the respective sides of said runners;

and portions of the sole of the wood body fitting in said slots and against the respective sides of said runners.

2. A golf club head according to claim 1 wherein the cross section of each of said runners has a depth of about 0.30 inch and a width of about 0.55 inch and said runners are spaced apart approximately 1.25 inches between centers.

3. A golf club head according to claim 1, wherein:

said sole plate having a rear edge surface below the sole of the wood;

said runners having flat rear end surfaces, which flat end surfaces incline downwardly and forwardly from said rear edge at an angle to the longitudinal front-to-rear lower surface of the respective runners;

and said sole plate rear edge surface is parallel with and mates with said rear faces of said runners forming a continuous substantially flat surface.

* * * * *